US008500528B2

(12) United States Patent
Leonhard et al.

(10) Patent No.: US 8,500,528 B2
(45) Date of Patent: Aug. 6, 2013

(54) COMBINATION BEARING, LINKAGE PIN AND SHAFT COUPLING FOR A DAMPER

(76) Inventors: Don A. Leonhard, Fishers, IN (US); Larry A. Green, Rushville, IN (US); Brian D. Beam, New Castle, IN (US)

( * ) Notice: Subject to any disclaimer, the term of this patent is extended or adjusted under 35 U.S.C. 154(b) by 1100 days.

(21) Appl. No.: 12/291,134

(22) Filed: Nov. 6, 2008

(65) Prior Publication Data

US 2010/0112931 A1 May 6, 2010

(51) Int. Cl.
*F24F 7/00* (2006.01)
*F24F 13/14* (2006.01)

(52) U.S. Cl.
USPC ..... 454/336; 454/325; 454/333; 454/334; 454/335

(58) Field of Classification Search
USPC ..... 454/325, 333, 334, 335
See application file for complete search history.

(56) References Cited

U.S. PATENT DOCUMENTS

| | | | | | |
|---|---|---|---|---|---|
| 2,903,257 | A | * | 9/1959 | Perrone | 49/82.1 |
| 3,191,241 | A | * | 6/1965 | Johnson | 454/335 |
| 3,267,962 | A | * | 8/1966 | Josephson et al. | 454/336 |
| 3,295,821 | A | * | 1/1967 | McQuown | 137/269 |
| 3,447,443 | A | * | 6/1969 | Silvey | 454/335 |
| 3,464,341 | A | * | 9/1969 | Dobrin | 454/336 |
| 3,718,081 | A | * | 2/1973 | Root | 454/335 |
| 3,894,481 | A | * | 7/1975 | Alley | 454/325 |
| 4,022,246 | A | * | 5/1977 | Janse | 454/335 |
| 4,275,762 | A | * | 6/1981 | Field | 454/335 |
| 4,312,381 | A | * | 1/1982 | Ratner | 137/636 |
| 4,506,825 | A | * | 3/1985 | Grant | 236/9 A |
| 4,513,534 | A | * | 4/1985 | Siegwart | 454/335 |
| 4,643,081 | A | * | 2/1987 | Vicinanza et al. | 454/278 |
| 4,749,000 | A | | 6/1988 | Ring et al. | |
| 4,749,001 | A | | 6/1988 | Ring et al. | |
| 4,775,133 | A | | 10/1988 | Ring et al. | |
| 5,009,114 | A | * | 4/1991 | Parsons | 475/174 |
| 5,238,453 | A | * | 8/1993 | Heil | 454/335 |
| 5,379,551 | A | * | 1/1995 | Swapp | 49/82.1 |
| 5,454,757 | A | | 10/1995 | Wirfel | |

(Continued)

FOREIGN PATENT DOCUMENTS

| | | | |
|---|---|---|---|
| EP | 0060112 | A2 * | 3/1982 |
| EP | 0060112 | A2 * | 9/1982 |

OTHER PUBLICATIONS

Avallone, et al., Marks' Standard Handbook for Mechanical Engineers, 1996, McGraw-Hill, Tenth Edition, pp. 8-43-8-45.*

*Primary Examiner* — Kang Hu
*Assistant Examiner* — Phillip E Decker
(74) *Attorney, Agent, or Firm* — William O'Driscoll

(57) ABSTRACT

An HVAC damper includes a sheet metal frame surrounding a series of pivotal damper blades that are each supported by a pair of plastic bearing members. Each bearing member is a unitary piece that includes a radial bearing, a thrust bearing, a lug for connecting to a damper blade, a shaft-receiving feature for connecting to a drive shaft, and multiple crank pins for selectively connecting to a drive linkage. Choosing which crank pin gets connected to the linkage determines a damper blade's rotational direction relative to the other damper blades. Adjacent damper blades preferably rotate in opposite directions to ensure positive sealing engagement between their adjacent blade tips. The bearing members allow the drive linkage to be installed outside the frame to avoid obstructing the airflow through the damper. During assembly, the bearing members allow the damper blades to be placed within the frame prior to installing the bearing members.

2 Claims, 4 Drawing Sheets

U.S. PATENT DOCUMENTS 5,506,502 A * 4/1996 Maennle ..... 324/207.25
5,580,307 A * 12/1996 Arosio et al. ..... 454/336
5,728,001 A 3/1998 Attridge, Jr.
5,730,653 A 3/1998 Van Becelaere
5,842,919 A * 12/1998 Lyons et al. ..... 454/336
5,887,386 A * 3/1999 Alexanian et al. ..... 49/403
6,263,632 B1 * 7/2001 Cadorette ..... 454/221
6,536,162 B2 * 3/2003 LaMay ..... 49/403
6,848,213 B1 * 2/2005 Swapp ..... 49/82.1
7,089,958 B2 8/2006 Schlosser et al.
7,124,537 B2 * 10/2006 Young ..... 49/74.1
7,726,752 B2 * 6/2010 Lin et al. ..... 312/223.2
2009/0188273 A1 * 7/2009 Dirnberger et al. ..... 454/333

* cited by examiner

COMBINATION BEARING, LINKAGE PIN AND SHAFT COUPLING FOR A DAMPER

FIELD OF THE INVENTION

The subject invention generally pertains to an air damper of an HVAC system (heating, ventilating and air conditioning system) and more specifically to a bearing and drive structure for such a damper.

BACKGROUND OF RELATED ART

HVAC dampers often include a series of damper blades that can pivot to various degrees of opening to regulate air flowing through the damper. The drive mechanism for pivoting the damper blades often comprises a complicated assembly of bearings, couplings, drive shafts, and linkages. The various drive components can be difficult to assemble, and often the components themselves extend into the airflow path, which can create an undesirable flow obstruction.

Some dampers have a frame made of sheet metal, which inherently has relatively thin, sharp edges. Such edges can make it difficult to radially support the shaft of a damper blade without the sheet metal edges cutting into the shaft.

Consequently, there is a need for a multi-blade damper that has a minimum number of parts, is easy to assemble, and provides little or no obstruction to air flowing through the damper.

SUMMARY OF THE INVENTION

It is an object of the invention to provide a bearing member that not only provides a damper blade with radial and axial support but also provides a means for coupling the damper blade to a drive shaft and to other damper blades.

Another object of some embodiments is to provide such a bearing member as a unitary piece that can be plastic injection molded.

Another object of some embodiments is to provide a bearing member with multiple crank pins that can be selectively connected to a linkage to provide selective clockwise or counterclockwise rotation of a damper blade.

Another object of some embodiments is to provide a plurality of identical bearing members each having multiple crank pins that can be selectively connected to a linkage to rotate a series of damper blades, wherein some blades rotate clockwise and others counterclockwise.

Another object of some embodiments is to provide a bearing member that includes a radial bearing surface, a thrust bearing surface, a lug for connecting to a damper blade, a shaft-receiving feature for connecting to a drive shaft, and multiple crank pins for connecting to one or more drive linkages, wherein the bearing member is a unitary piece that can be plastic injection molded.

Another object of some embodiments is to provide a damper frame made of sheet metal that provides a journal bearing surface and a thrust bearing surface without having to rely on the very edges of the sheet metal to support a damper blade, drive shaft, or plastic bearing member.

Another object of some embodiments is to enable the assembly a damper by first positioning a series of damper blades within a frame and subsequently installing bearing members that support the damper blades in both radial and axial directions.

One or more of these and/or other objects of the invention are provided by a damper that includes a plastic bearing member made of a unitary piece that supports a damper blade, wherein the bearing member includes a radial bearing surface, a thrust bearing surface, a lug for connecting to a damper blade, a shaft-receiving feature for connecting to a drive shaft, and multiple crank pins for selectively connecting to one or more drive linkages.

DESCRIPTION OF THE PREFERRED EMBODIMENT

Figure 1:
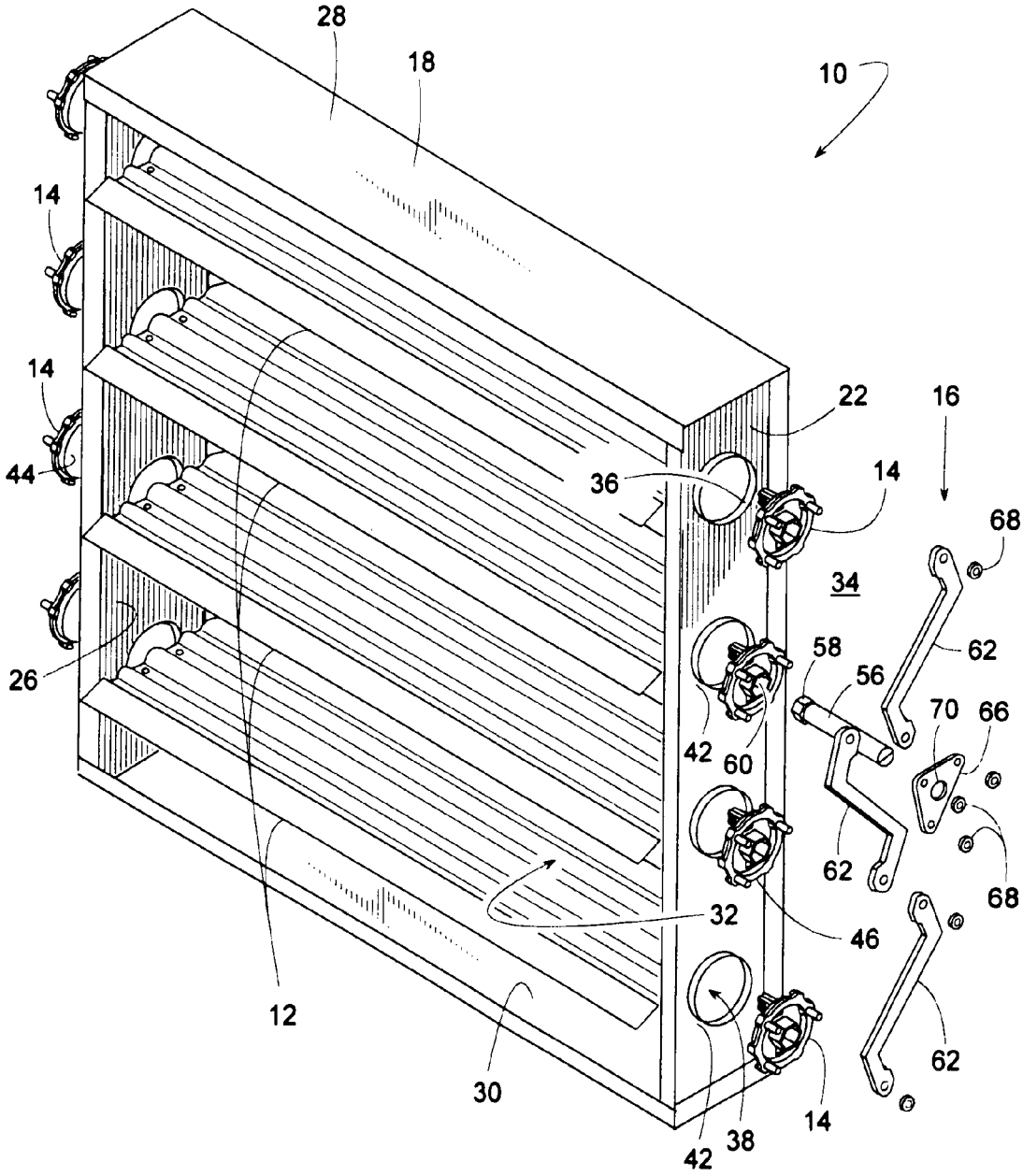
FIG. 1 is an exploded perspective view of a damper.
Figure 2:
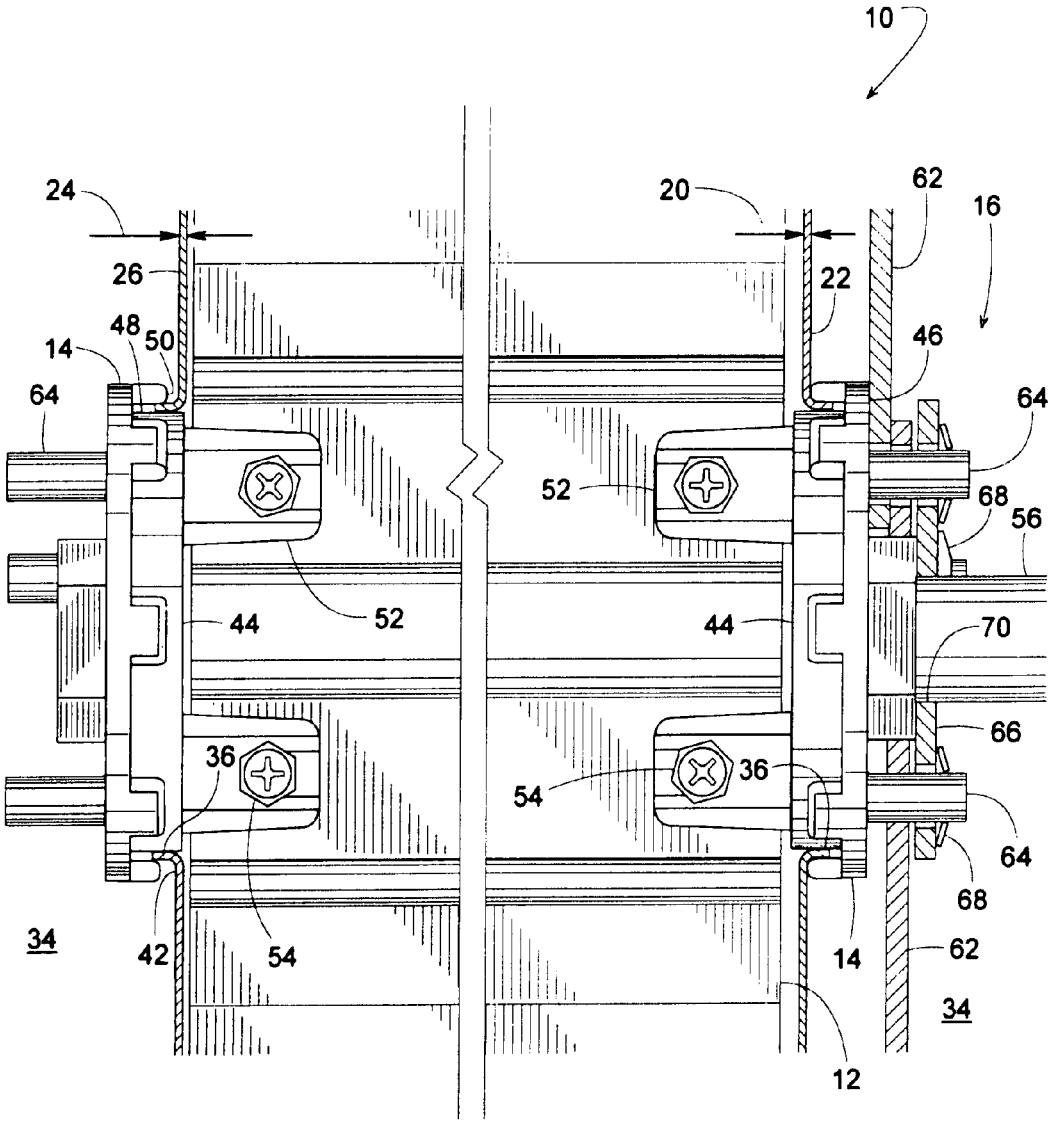
FIG. 2 is a partial cross-sectional view taken generally along line 2-2 of FIG. 3 and showing a damper blade supported by two substantially identical plastic bearing members.
Figure 3:
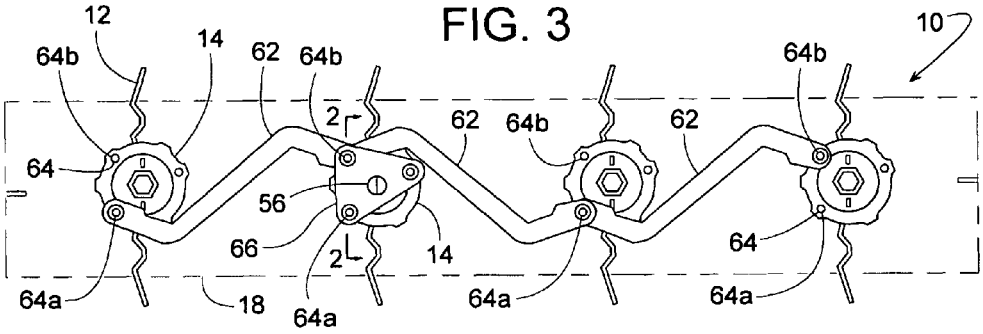
FIG. 3 is an end view of a damper with its frame shown in phantom lines.
Figure 4:
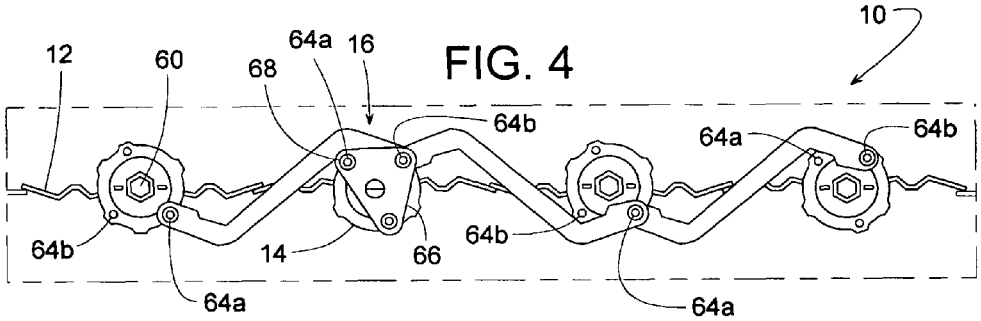
FIG. 4 is an end view similar to FIG. 3 but showing the damper closed.

FIG. 1 shows an exploded view of a damper 10 that, when assembled as shown in FIG. 2, can rotate a plurality of damper blades 12 between an open position (FIGS. 1 and 3) and a closed position (FIGS. 2 and 4). Damper 10 can be used in various HVAC systems to control airflow such as, for instance, return airflow, exhaust airflow, incoming fresh outdoor airflow, supply airflow, and various mixtures thereof. To open or close damper 10, a plurality of novel bearing members 14 couple a drive mechanism 16 to damper blades 14.

The basic components of damper 10 include a frame 18, at least one damper blade 12, at least one bearing member 14, and drive mechanism 16. Although the actually construction, arrangement and quantity of parts may vary, the present invention will be described with reference to the example shown in FIGS. 1-6.

For this example, damper 10 happens to have four damper blades 14; however, any number of damper blades would be well within the scope of the invention. For the illustrated embodiment, frame 18 is formed of sheet metal having a nominal material thickness that preferably is uniform but not necessarily so. Dimension 20 of FIG. 2 identifies a first material thickness of a first side frame member 22, and dimension 24 identifies a second material thickness of a second side frame member 26, wherein both thickness values 22 and 24 can be the same. Frame 18 includes first side frame member 22, second side frame member 26, an upper frame member 28 and a lower frame member 30. The four frame members 22, 26, 28 and 30 are arranged in a generally rectangular shape to define an inner airflow passageway 32 and an outer area 34. The rotational position of damper blades 12 (e.g., their position of FIG. 3 vs. FIG. 4) determines the degree of opening of the damper's passageway 32.

Figure 6:
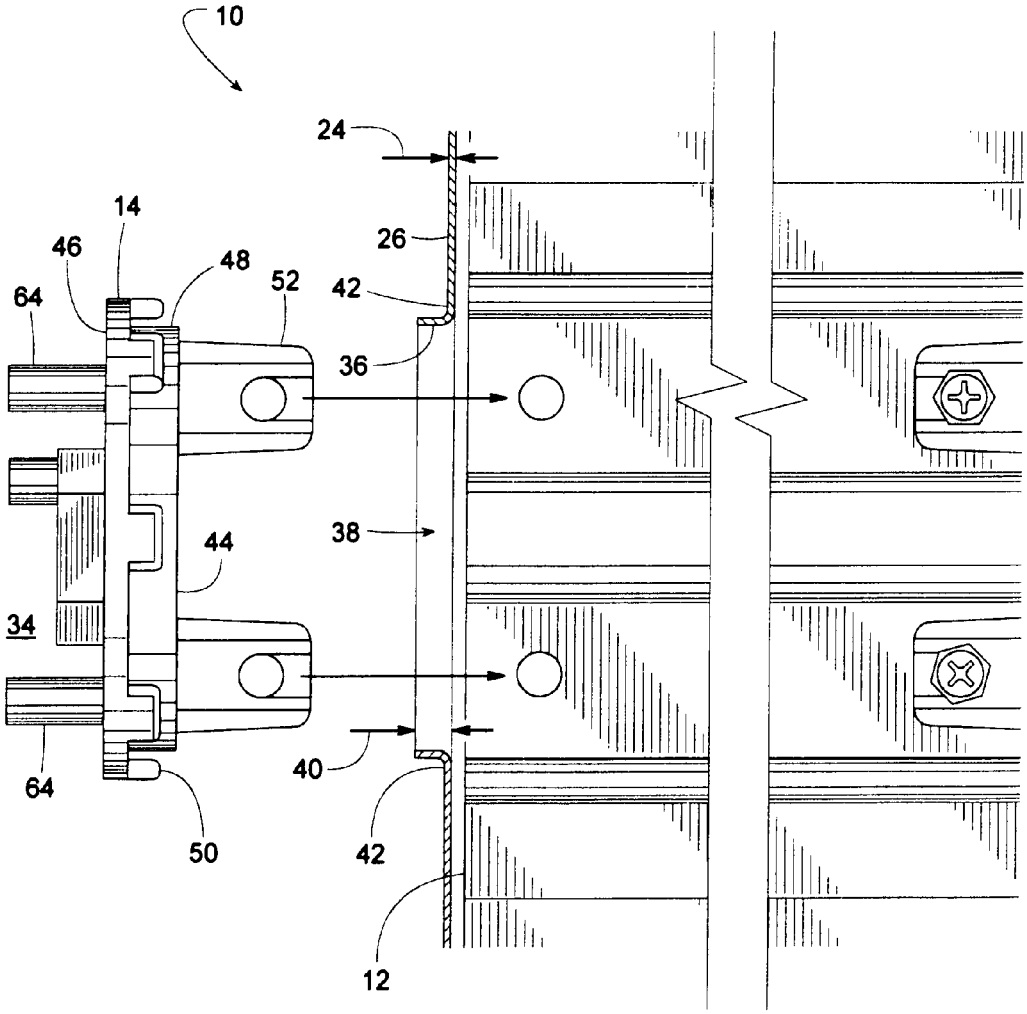
FIG. 6 is a cross-sectional view similar to the right section of FIG. 2 but showing the bearing member in the process of being installed.

First and second side frame members 22 and 26 each include a journal bearing surface 36 that defines a substantially cylindrical hole 38. Referring to FIG. 6, journal bearing surface 36 has an axial length 40 that is greater than the material thickness 20 or 24 of the side frame member in which journal bearing surface 36 is formed (or otherwise disposed). Each side frame member 22 and 26 also includes a fixed thrust bearing surface 42 encircling hole 38 and facing outer area 34.

Bearing members 14 protrude through each hole 38 of side members 22 and 26 such that bearing members 14 can be installed after first positioning damper blades 12 within frame 18. Bearing member 14 includes a drive side 44 facing passageway 32 and a driven side 46 facing outer area 34. Bearing member 14 also includes a radial bearing surface 48 and a thrust bearing surface 50 that in an axial direction are between sides 44 and 46. Blade-mounting lugs 52 integrally extending from drive side 44 are affixed to damper blade 12 by some suitable means including, but not limited to, screws 54, rivets, adhesive, or snap-in connection. Radial bearing surface 48 of bearing member 14 is radially supported by journal bearing surface 36 such that bearing member 14 can rotate within hole 38. Rotatable thrust bearing surface 50 engaging fixed thrust bearing surface 42 of first side frame member 22 limits how far damper blade 12 can move away from first side frame member 22. Likewise, rotatable thrust bearing surface 50 engaging fixed thrust bearing surface 42 of second side frame member 26 limits how far damper blade 12 can move away from second side frame member 26.

Figure 5:
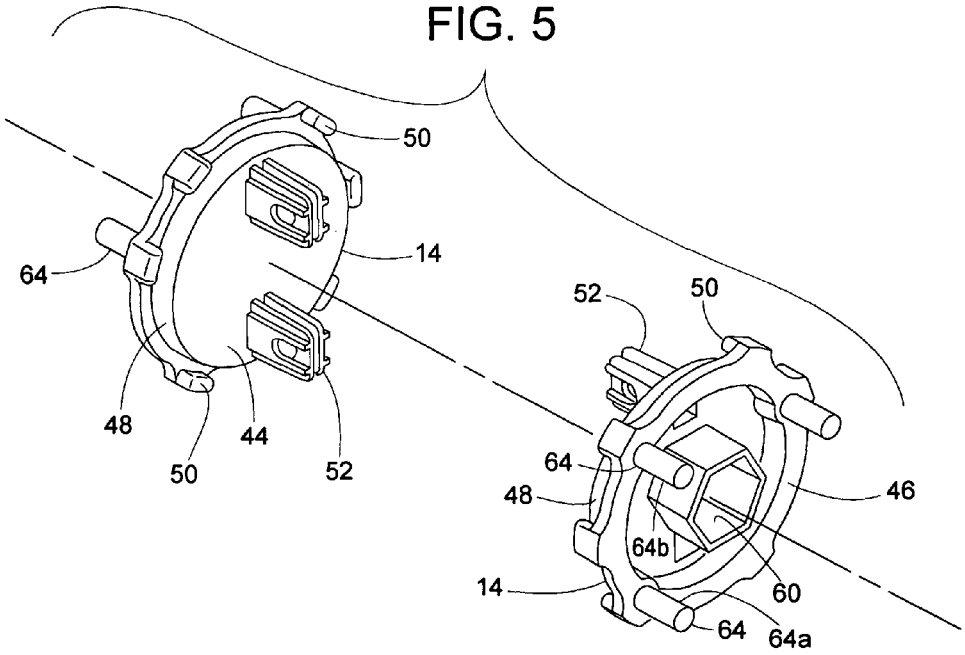
FIG. 5 is a perspective view of a pair of substantially identical bearing members.

Each bearing member 14 preferably is made of a polymeric material that can be cast or plastic injection molded as a unitary piece, as shown in FIG. 5. The term, "polymeric material" means any material that includes a polymer with or without nonpolymer additives. One example of a suitable material is 33% glass filled nylon 6/6; however, countless other plastic materials are conceivable and well within the scope of the invention.

Drive mechanism 16 could be of any suitable design. For the illustrated example, drive mechanism 16 includes a drive shaft 56 with a radially enlarged hexagon head 58 that tightly fits into a hexagon socket 60 in bearing member 14 such that a radial interference fit exists between head 58 and socket 60. Socket 60 is just one of many possible examples of a shaft-receiving feature that bearing member 14 could have for connecting to shaft 56 or some other suitable drive shaft. The connection between drive shaft 56 and bearing member 14 is such that rotation of shaft 56 rotates at least one damper blade 12.

In order for shaft 56 to rotate all the damper blades 12, a plurality of drive links 62 connect to certain crank pins 64 that extend integrally from driven side 46 of each bearing member 14. Pins 64 that are to be connected to drive links 62 are selectively chosen such that adjacent damper blades 12 preferably rotate in opposite directions (clockwise/counterclockwise) to ensure smooth sealing engagement of the blade tips when damper 10 closes. Each bearing member 14 having multiple pins 64 (e.g., pin 64*a*and 64*b*) to which linkages 62 can be selectively connected enable bearing members 14 to be used for dampers with two, three, four, or any number of damper blades. To prevent adjacent blade tips from jamming end-to-end, the position of pins 64 and the connection of links 62 are such that the blade tips rotate at different rotational speeds as they approach their point of engagement with each other. It can be seen in FIGS. 3 and 4 that pin 64*a* (pin-A) and pin 64*b* (pin-B) are asymmetrically oriented on the driven side 46 of each bearing member 14 such that pin 64*a* and pin 64*b* are distinguishable from each other with respect to their orientation on bearing member 14. It is clear from FIGS. 3 and 4 that link 62 connecting a pin-A selectively to a pin-B ensures that adjacent damper blades 12 rotate in opposite directions. Alternatively, a similar link connecting a pin-A selectively to another pin-A ensures that adjacent damper blades 12 rotate in the same direction, if so desired (e.g., if it were desired to have the airflow directed in a certain direction up or down when the damper was partially open).

To help hold head 58 of drive shaft 56 within socket 60, to help evenly transmit a rotational moment to bearing members 14, and to help hold linkages 62 to pins 64, drive mechanism 16 includes a shaft retainer plate 66 that connects to multiple pins 64 of bearing member 14. A suitable fastener 68 can be used to hold shaft retainer plate 66 in place. Examples of fastener 68 include, but are not limited to, a push nut, clip, retainer ring, pin, etc. The installation of plate 66 is such that linkages 64 are captured between plate 66 and driven side 46, and hexagon head 58 is captured within socket 60 because head 58 is too large radially to fit through a central hole 70 in plate 66.

Although the invention is described with respect to a preferred embodiment, modifications thereto will be apparent to those of ordinary skill in the art. The scope of the invention, therefore, is to be determined by reference to the following claims:

The invention claimed is:

1. A damper, comprising:

a frame comprising a first side frame member having a first material thickness and a second side frame member having a second material thickness, the frame defines an inner airflow passageway and an outer area, wherein the inner airflow passageway is between the first side frame member and the second side frame member, the first side frame member includes a journal bearing surface that defines a substantially cylindrical hole, the journal bearing surface has an axial length that is greater than the first material thickness of the first side frame member also includes a fixed thrust bearing surface encircling the substantially cylindrical hole and facing the outer area;

a damper blade disposed within the inner airflow passageway between the first side frame member and the second side frame member;

a bearing member protruding through the substantially cylindrical hole in the first side member, the bearing member includes a drive side, a driven side, and a radial bearing surface between the drive side and the driven side, and a rotatable thrust bearing surface between the drive side and the driven side, the drive side is affixed to the damper blade, the driven side extends into outer area, the radial bearing surface is radially supported by the journal bearing surface such that the bearing member can rotate relative to the journal bearing surface, and the rotatable thrust bearing surface engages the fixed thrust bearing surface thereby limiting how far the damper blade can move away from the first side frame member; and a drive mechanism disposed within the outer area and being connected to the driven side of the bearing member to impart a rotational moment on the bearing member such that rotation of the bearing member rotates the damper blade, the bearing member including the drive side, the driven side, the rotatable thrust bearing surface, and the radial bearing surface is a unitary piece of a polymeric material;

a drive shaft, two crank pins, and a shaft retainer plate all of which are disposed in the outer area, the drive shaft is part of the drive mechanism and is attached to the driven side of the bearing member, the two crank pins extend from the driven side of the bearing member and connect the shaft retainer plate to the bearing member, and the shaft retainer plate is connected to the drive shaft; and the drive mechanism includes a drive link selectively connected to one of the two crank pins at the exclusion of the other, the two crank pins are asymmetrically oriented on the bearing member such that the two crank pins are distinguishable from each other with respect to their orientation, and the two crank pins are included in the unitary piece of the polymeric material.

2. The damper of claim 1, further comprising a plurality of damper blades that includes the damper blade, and the drive mechanism is coupled to the plurality of damper blades such that at least two damper blades of the plurality of damper blade rotate in opposite directions to each other.

* * * * *